US005182937A

United States Patent [19]

Dickson

[11] Patent Number: 5,182,937

[45] Date of Patent: Feb. 2, 1993

[54] SEAM-FREE THREAD ROLLING DIES

[75] Inventor: Joseph F. Dickson, Jefferson, Mass.

[73] Assignee: Quamco, Inc., Holden, Mass.

[21] Appl. No.: 761,413

[22] Filed: Sep. 17, 1991

[51] Int. Cl.[5] ..... B21H 3/06

[52] U.S. Cl. ..... 72/469; 72/88; 72/103

[58] Field of Search ..... 72/469, 88, 90, 103, 72/92, 93

[56] References Cited

U.S. PATENT DOCUMENTS

| | | | |
|---|---|---|---|
| 618,262 | 1/1899 | Ames | 72/469 |
| 3,204,442 | 9/1965 | Wieber | 72/469 |
| 4,065,948 | 1/1978 | Tsukamoto | 72/469 |

FOREIGN PATENT DOCUMENTS

| | | | |
|---|---|---|---|
| 856634 | 8/1981 | U.S.S.R. | 72/103 |
| 2063740 | 6/1981 | United Kingdom | 72/90 |

*Primary Examiner*—Daniel C. Crane

*Attorney, Agent, or Firm*—Chilton, Alix & Van Kirk

[57] ABSTRACT

A seamless helical thread is formed through the use of a die having a thread profile defining groove which undergoes a smooth transition from a pointed form at the starting end to a finish form. The transition occurs along the portion of the groove length where the groove depth is increasing. In the case of a typical machine screw with a 60° finish form, the pointed form is approximately 98°.

8 Claims, 4 Drawing Sheets

SEAM-FREE THREAD ROLLING DIES

BACKGROUND OF THE INVENTION

1. Field of the Invention.

The present invention relates to the formation of threaded fasteners and particularly to the generation of rolled form helical threads. More specifically, this invention is directed to tooling for forming seam-free threads in fastener blanks and especially to dies having a unique thread profile geometry. Accordingly, the general objects of the present invention are to provide novel and improved methods and apparatus of such character.

2. Description of the Prior Art

The formation of a threaded fastener by subjecting a generally cylindrically-shaped portion of a preformed metal blank to a thread-rolling process is well known and will not be described in detail herein. It should suffice to note that a widely used technique, which enables quality threaded fasteners to be produced at high production rates, involves serial feeding of the preformed fastener blanks into the gap between a pair of "flat" thread-rolling dies. By imparting planar motion to one of the flat dies relative to the other, a blank disposed between the dies will be caused to roll as it traverses the length of the stationary die. During the rolling of the blank, because of the forces applied thereto by the dies, the metal comprising the blank will flow so as to form a thread having a shape determined by the profile of the lands and grooves machined in the opposing faces of the dies.

Fasteners having conventional rolled threads, fasteners formed in accordance with the above-briefly described prior art technique which employs a pair of flat thread-rolling dies for example, are suitable for most applications. It is to be noted, however, that the generation of rolled form helical threads will typically produce a thread characterized by a crest seam or seams, i.e., a fissure at the crest of the thread. In accordance with SAE specification AS7456, issued Feb. 19, 1991, seams at the roots of a thread or in the flanks of a thread below the "pitch line" or midpoint of the thread depth are generally not permissible, but a seam in the thread crest, which is sometimes referred to as a crest lap or crest crater, may be tolerated if not of excessive size. However, in many applications, especially where cleanliness is critical, a crest seam provides a potential haven for bacteria and other contaminants. Accordingly, a thread-rolling technique and apparatus which would produce a seam-free thread without a significant reduction in obtainable production rates has been long desired.

It is to be noted that previous attempts to meet the above-mentioned long standing desire for a mass-produced seam-free rolled helical thread have encountered numerous obstacles. The most prevalent of these obstacles, where the use of flat thread-rolling die geometry is the technique of choice, has been slippage of the blank being worked during transfer of the thread form from the die to the workpiece as one of the two cooperating dies rotates the workpiece. Any such slippage will result in the production of a defective thread.

SUMMARY OF THE INVENTION

The present invention overcomes the above-briefly discussed and other deficiencies and disadvantages of the prior art by providing a unique process for the generation of seam-free rolled-form helical threads. The present invention also encompasses a novel thread-forming die thread profile geometry which may be employed to implement this unique process. This novel die thread profile geometry causes a balanced radial flow of the blank material which avoids the formation of seams, laps, and craters.

A thread-rolling die in accordance with the present invention is characterized by a thread profile geometry which, at its starting end, has a pointed or sharpened form wherein the facing side walls or flanks which define each groove diverge at a wide angle. The die profile undergoes a smooth transition to the finish form, as the thread depth increases, from the starting end to the dwell portion of the die. During this transition, the thread profile geometry will have a double form, i.e., the transition will progress outwardly toward the crest as the pointed form evolves to the acute angle of the finish form. The pointed form will, as this evolution occurs, fade out at the start of the dwell region.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
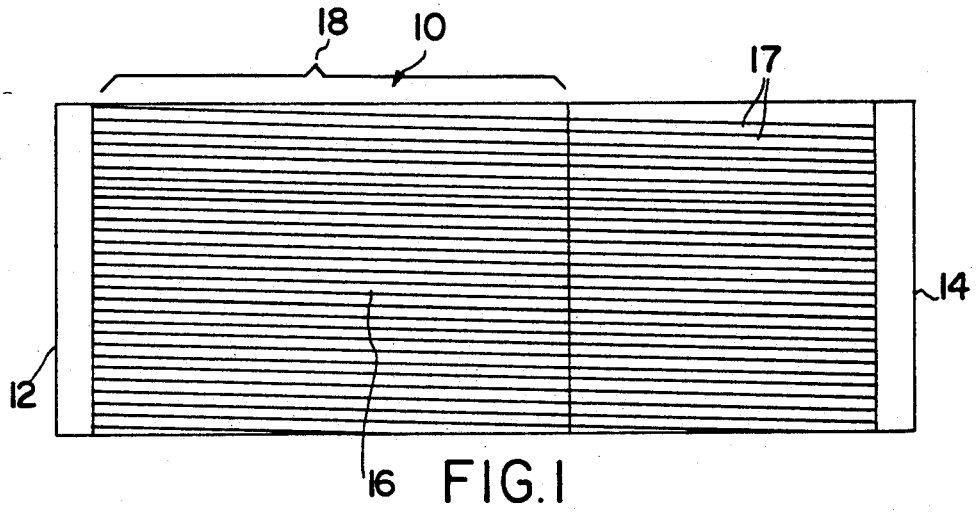
FIG. 1 is a top view of one of a pair of cooperating flat thread-rolling dies in accordance with the invention, the other die appearing substantially the same when similarly viewed.
Figure 2:
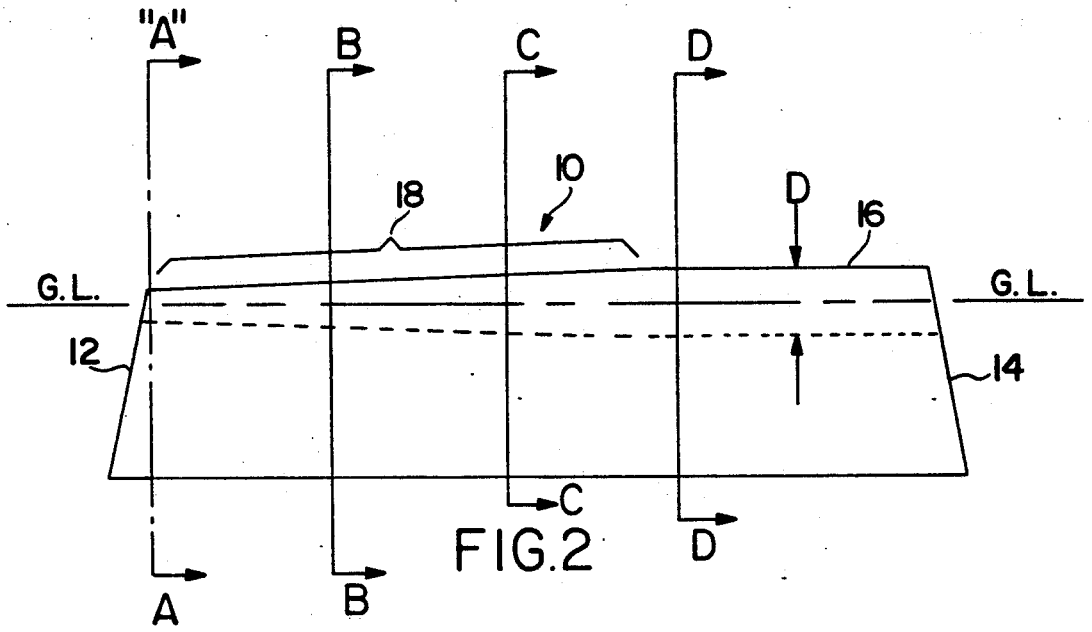
FIG. 2 is a side elevation view of the die of FIG. 1, the cooperating die appearing substantially the same when similarly viewed.

With reference now to the drawings, a "flat" thread-rolling die in accordance with the invention is shown, respectively in top and side views, in FIGS. 1 and 2. FIGS. 1 and 2 may be considered as showing either the stationary or "short" die or the reciprocating or "long" die of a pair of cooperating flat dies. The die of FIGS. 1 and 2 is intended for the manufacture of machine screws having a 60° finish form. This die, which is indicated generally at 10, has a starting end 12 and finish end 14. The face 16 of the die is machined so as to have parallel lands and grooves 17 shaped in accordance with a thread-forming profile. As a blank rolls from the starting end to the finish end of the dies as a result of the motion of the "long" die, while being subjected to compression, the material comprising the blank will flow to define a helical thread. The die 10, with the exception of the unique thread profile geometry to be described, is of conventional construction.

Figure 3:
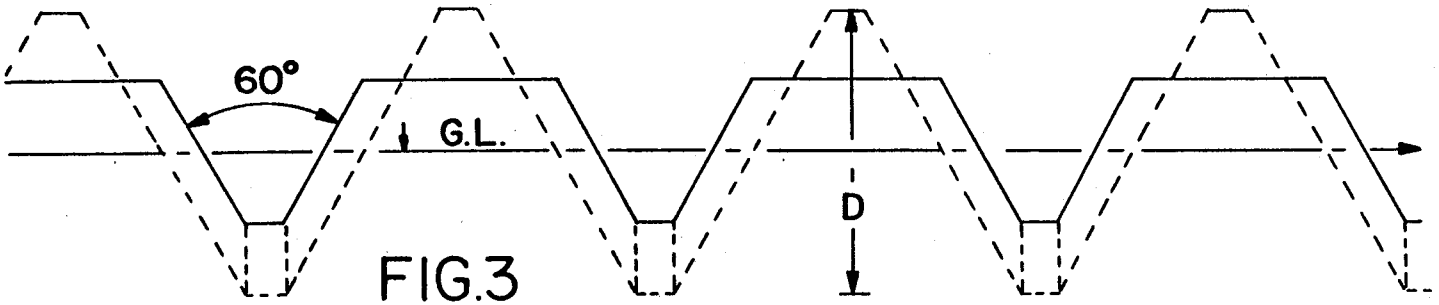
FIG. 3 is a partial end view, on an enlarged scale and taken in direction A—A of FIG. 2, which schematically shows the die at an intermediate stage in the formation thereof.

With reference to FIG. 3, which is a partial view taken along line A—A of FIG. 2 depicting the die 10 at an intermediate stage of the machining of the thread profile in face 16, the solid lines indicate the thread form at the starting end 12 of the "short" die and the matching point on the "long" or reciprocating die. The broken line showing indicates the thread form at the finish end of the dies. The finish end thread depth is indicated at D and, by reference to FIG. 2, it may be seen that the thread depth increases symmetrically, from the starting end 12 to the beginning of the "dwell" region of the die, about a pitch or groove line G. L. In the disclosed embodiment, the flanks of facing threads of the fastener to be formed, and thus the facing sides of the grooves of die 10 at the finish end, intersect at an angle of 60°. While the crest and roots of the die profile are depicted as flat in FIGS. 3 and 4, in actual practice these portions of the profile will be rounded as represented in FIG. 5.

Figure 4:
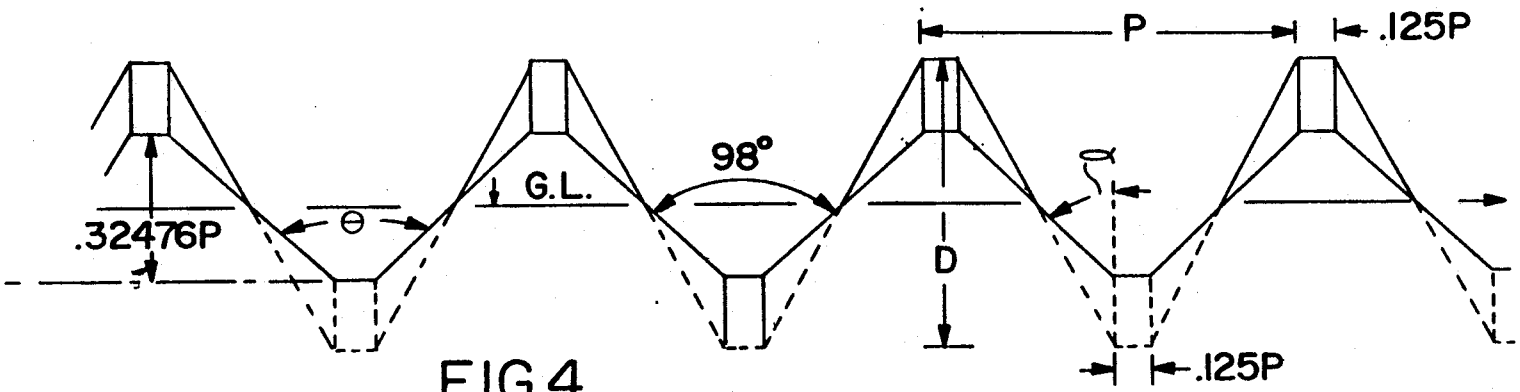
FIG. 4 is a partial end view, taken along line A—A of FIG. 2, which schematically shows the completed die on an enlarged scale.

In accordance with the present invention, the die thread profile is "pointed", i.e., the profile is provided with a sharpened thread form, at the starting end 12 of the "short" die, and the matching point on the "long" die. This "pointed" thread form is obtained by further machining, after the thread profile configuration of FIG. 3 has been obtained, to produce the thread profile geometry of FIG. 4. FIG. 4 shows that, at the starting end of a die for producing a machine screw with a 60° finish form, the angle of divergence of the facing sides of the grooves is approximately 98°. This 98° "pointing" of the 60° thread form has, most unexpectedly, been found to eliminate the formation of crest seams. There will be a smooth transition from the 98° pointing to the 60° finish end thread form along that portion of the length of the die where the thread depth D is gradually increased, i.e., before the dwell region of the die. This region where thread depth gradually increases is indicated at 18 on FIGS. 1 and 2 and corresponds to that portion of the die, extending from the starting end, where the crest of the thread profile is machined at a predetermined taper.

Figures 5A, 5B, 5C, 5D:
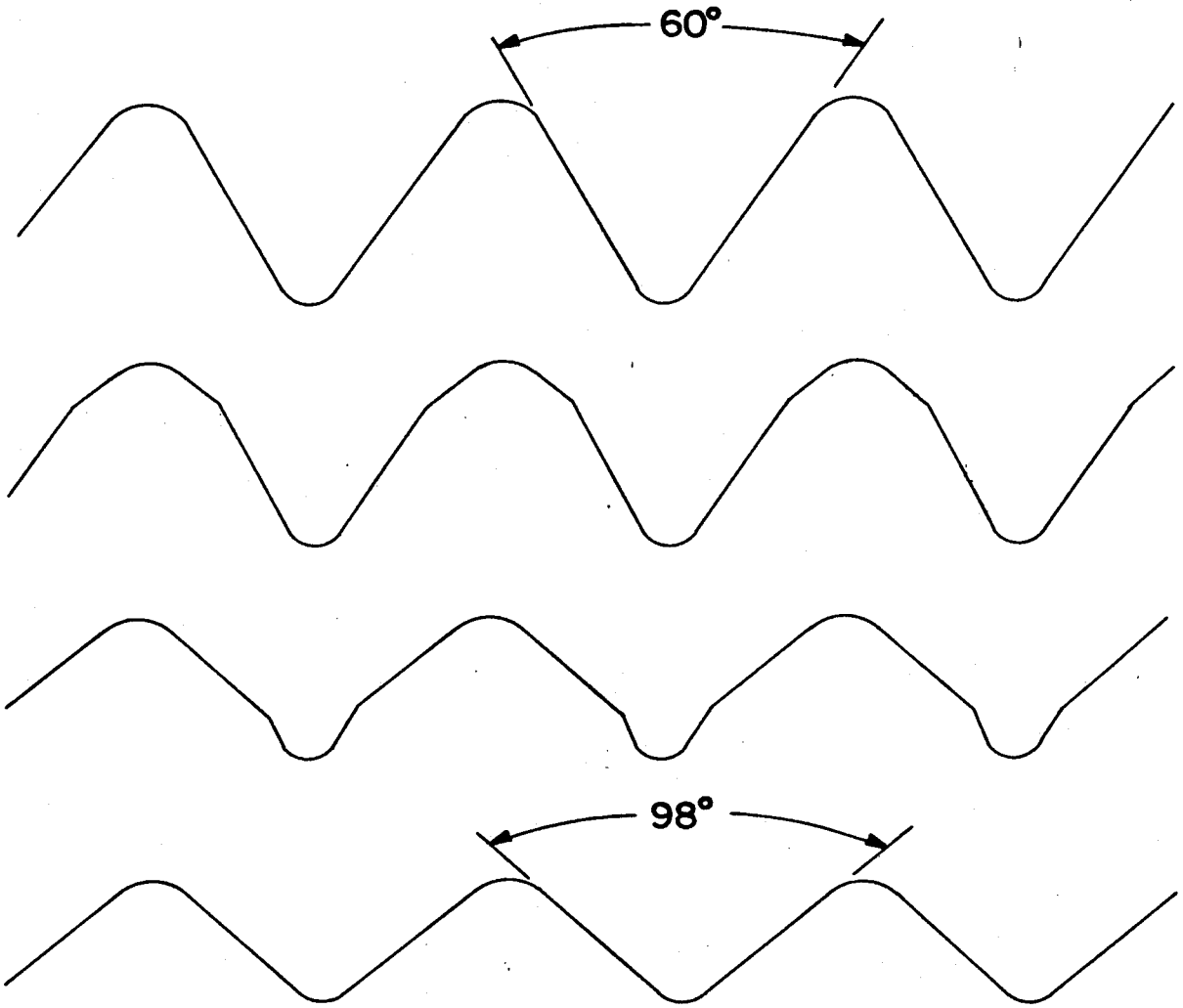
FIG. 5 is a graphical representation of the thread profile cross-section of the die of FIGS. 1-4 at four points, including the starting and finish positions, along the length of the die.
Figure 6A:
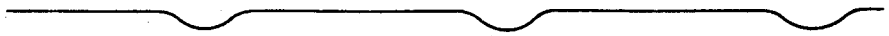
FIG. 6 is a schematic cross-section of a fastener rolled at varying thread fullness, FIG. 5 illustrating the progressive increase in the profile of a thread produced in accordance with the invention.
Figure 6B:
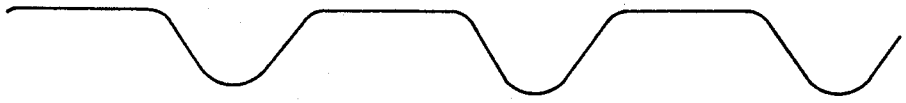
Figure 6C:
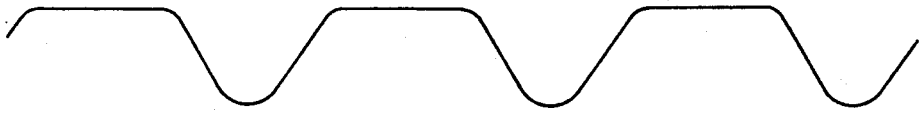
Figure 6D:
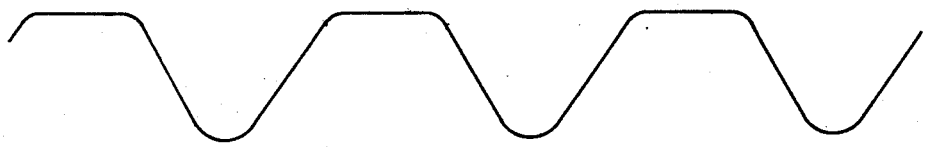
Figure 6E:
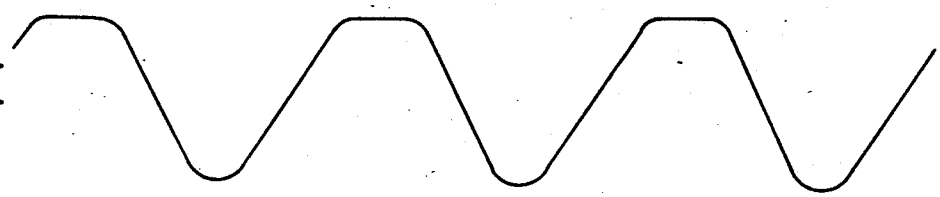
Figure 6F:
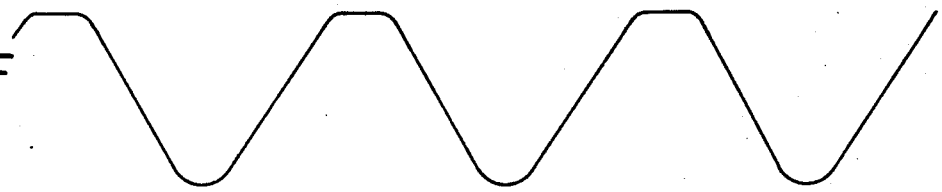
Figure 6G:
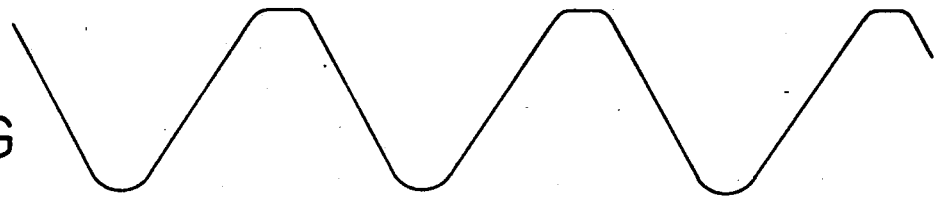
Figure 6H:
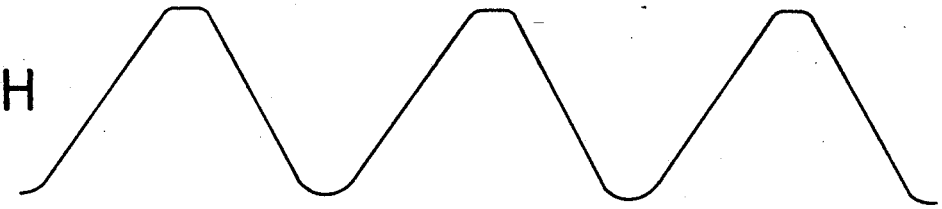

FIG. 5 graphically depicts the actual die thread forming profile at the starting end and at three successively distant points along the length of the die. FIG. 5 clearly shows the smooth transition between the pointed thread form at the starting end and the desired final thread form. FIG. 5 also shows that, as the transition occurs, the groove profile has a double form. The pointed form fades out at the beginning of the dwell region. Curves 5A-5D may respectively be considered to be views taken along lines A—A, B—B, C—C, and D—D of FIG. 2.

FIG. 6, progressing from curve No. 1 through curve No. 8, shows various stages in the formation of a seam-free thread in accordance with the present invention and employing the above-described tooling. As may be seen from FIG. 6, as a blank passes between a pair of the flat dies produced in accordance with the invention, and the thread is formed therein, the metal will flow in such a manner that the crest of each thread is formed smoothly by a balanced radial flow of material whereby crest seams and craters are avoided.

The present invention is predicated upon the discovery that seam-free threads will result from a critical pointing of the thread form at the starting end of the thread-forming die. This critical pointing, i.e., the angle transcribed by the facing flanks of the die profile, is independent of pitch P. Referring to FIG. 4, wherein the pointing angle is twice the angle $\alpha$ the pointing angle may be calculated as follows:

$$Tan\cdot\alpha = 0.375P/0.32476P = 49^\circ\ 6'\ 24'' \quad (1)$$

where the thread depth D is 0.32476P, the width of the thread root and the crest of the thread are each 0.125p and $$\theta = 2\alpha = 98^\circ\ 12'\ 48'' \quad (2)$$

and, accordingly, $$\theta = 2\ TAN.^{-1}(0.375/0.32476) \quad (3)$$

Thus, in the practice of the present invention, to produce a helical thread having a 60° finish form, the thread form as defined by the profile of the die is "pointed" to an angle as close to 98° 12′ 48″ as permitted by manufacturing tolerances at the starting end of the "short" die (and at the matching point on the "long" die) and, from this pointing angle, there is a smooth transition to the desired 60° die finish end thread form.

While the present invention has been described in connection with what is presently considered to be the most practical and preferred embodiment, it is to be understood that the invention is not limited to the disclosed embodiment, but rather is intended to cover various modifications and equivalents included within the spirit and scope of the appended claims. Thus, while the invention has been described as embodied in a flat rolling die, it will be understood by those skilled in the art that the novel thread profile geometry is applicable to cylindrical and planetary dies. Also, while the above-described die is designed for use in the manufacture of machine screws, the invention is applicable to the manufacture of fasteners having acme and worm threads.

What is claimed is:

1. In a die for use in the formation of a helical thread in a metal blank, the die being provided with at least a first thread forming groove in a face thereof which contacts the blank, the groove having a base region and a pair of oppositely facing side walls, the side walls extending from the groove base region to the said face of the die, an improved thread profile defining groove geometry comprising:

a dwell portion wherein the depth of the groove is substantially constant, said dwell portion terminating at the discharge end of the groove, the side walls of the groove diverging from the base region within said dwell portion at a constant average acute angle which is commensurate with the finish configuration of the thread to be formed; and a second portion which extends from the starting end of the groove to said dwell portion, the depth of the groove increasing progressively and smoothly between said starting end and said dwell portion, said side walls having an angle of divergence at said starting end which is greater than said acute angle of divergence in said dwell portion, the shape of said side walls undergoing a smooth transition from said starting end to said dwell portion as the depth of the groove increases, said transition beginning at the base region of the groove and progressing outwardly toward the face of the die whereby said side walls have a double form in that portion of the length thereof disposed between said groove starting end and said dwell portion.

2. The article of claim 1 wherein said die is a flat thread rolling die with plural parallel grooves, and said groove depth varies symmetrically with respect to a pitch line.

3. The article of claim 1 wherein said angle of divergence within said dwell region of said groove is approximately 60° and said angle of divergence at the starting end of said groove is approximately 98°.

4. The article of claim 2 wherein said angle of divergence within said dwell region of said groove is approximately 60° and said angle of divergence at the starting end of said groove is approximately 98°.

5. The article of claim 1 wherein said angle of divergence at said groove starting end is an obtuse angle.

6. The article of claim 5 wherein the die cooperates with a second matching die and each of said dies has a plurality of said grooves, rolling motion being imparted to a blank by causing one of said dies to move linearly with respect to the other die.

7. The article of claim 6 wherein said angle of divergence within said dwell region of said grooves is approximately 60° and said angle of divergence at the starting end of said grooves is approximately 98°.

8. The article of claim 7 wherein the depth of each of said grooves varies symmetrically with respect to a pitch line, said pitch lines defining plane, the die motion which causes a blank to roll while moving from the start end of the die to the discharge end being in a direction which is parallel to said plane.

* * * * *